United States Patent [19]

Balogh

[11] 4,054,748

[45] Oct. 18, 1977

[54] CARDIOID ELECTRO-ACOUSTIC RADIATOR

[75] Inventor: Géza Balogh, Budapest, Hungary

[73] Assignee: Elektroakusztikai Gyar, Budapest, Hungary

[21] Appl. No.: 715,143

[22] Filed: Aug. 17, 1976

[30] Foreign Application Priority Data

Oct. 22, 1975 Hungary ..... EE 2382

[51] Int. Cl.[2] ..... H04R 1/20

[52] U.S. Cl. ..... 179/1 E; 181/199

[58] Field of Search ..... 179/1 E; 181/148, 156, 181/175, 199

[56] References Cited

U.S. PATENT DOCUMENTS

| | | | |
|---|---|---|---|
| 3,722,616 | 3/1973 | Beavers | 179/121 D |
| 3,739,096 | 6/1973 | Iding | 179/1 E |

*Primary Examiner*—George G. Stellar
*Attorney, Agent, or Firm*—Young & Thompson

[57] ABSTRACT

The subject matter of the invention is a directional electro-acoustical converter, primarily a cardioid sound radiator which, in spite of its small dimensions, has cardioid directivity diagram and at the same time wide transmission band.

The known solutions of the cardioid sound radiator have frequency responses falling towards the low frequencies thus being generally suitable for the transmission of speech informations. On the contrary, the directional converter according to the invention provides for a wide transmission band in the loudspeaker operating method being thus suitable for the transmission of musical programs, too. To the membrane of the converter according to the invention at least two phase shifting members having different sound route distances are coupled by means of acoustic coupling elements. The phase shifting members, and their coupling elements, respectively, have such a value that the quarter of the wave length corresponding to the transposition frequency produced by them is at least identical with, but at most the quadruple of the value of the smallest sound route distance. With this solution a nearly straight frequency response within the transmission band, cardioid directivity diagram and various variants thereof, respectively, can be provided for.

6 Claims, 9 Drawing Figures

CARDIOID ELECTRO-ACOUSTIC RADIATOR

The subject matter of the invention is a directional electro-acoustical converter, primarily loudspeaker and acoustic radiator, which has at least two phase shifting members known by themselves being acoustically connected to each other and to the membrane in such a way that the sound radiator has cardioid directivity pattern and that according to various types of the cardioid shape but, at the same time, it has, as against the known solutions, suitably wide-band frequency characteristic.

It is well known that efforts are made all over the world to the development of directional electro-acoustical converters one of the main advantage of which as against the non-directional converters consists in that they reduce the acoustical singing tendency and the resonation. In rooms of especially poor acoustics they considerably increase the intelligibility, the realistic respresentation and "clarity" of broadcast transmission. These converters render possible the selection of sound direction. The above enumerated advantages may be and shall be separately interpreted from point of view both of sound carriers/microphones/and of sound transmitters/acoustic radiators/. As for the microphones, the use of the cardioid type is already rather universal.

Wide-band microphones of straight frequency characteristic and of cardioid directivity diagram in each band are produced in large series all over the world and these types practically superseded the converters of non-directional type. For the cardioid converters so-called phase-shifting members are used being equalized to first degree or second degree. [Weingartner: "Das dynamische Sweiwegmikrofon" Funktechnik 20, 5, 1965; further Iding: "Unidirectionally radiating loudspeakers" AES Conf. 14–16, 3, 1972, Munich].

In case of condenser microphones, the establishment of cardioid directivity diagram is nearly problemfree, due to the principle of operation. In case of electrodynamic moving-coil microphones the establishment of cardioid directivity diagram above the self-resonance of the membrane is obvious and, like with the condenser microphone, it can be simply achieved with a single phase-shifting member, without compensation, in case of straight frequency characteristic. Since the self-resonance of the membrane can be taken as being fairly low, that is it may be found in the low-frequency range of the transmission band, near the lower limiting frequency, the enlargement of the transmission band to the necessary extent means a rather simple task, maintaining simultaneously the cardioid directivity diagram. For this purpose several, already well-known and approved solutions have been brought about.

The situation is quite different with the electrodynamic moving-coil loudspeakers, acoustic radiators. In the higher-frequency range — since the transmitting membrane is commensurate with the wavelength — the directionality occurs of itself and should not be separately established. [Beranek: "Acoustics" — McGraw-Hill 1954, London, p. 104]. On the contrary, in several cases the problem is caused by that the directionality is exaggerated especially as compared to the lower frequencies, and this exaggerated directionality [bunched directivity diagram] is intended to be discontinued. [Beranek: "Acoustics", pp. 201 – 203; further Olsen: Elements of Acoustical Engineering," New York, 1947, pp. 135 – 144]. At medium frequencies the increase of the directionality is, however, necessary. A generally known method for this purpose is the common use of several loudspeakers in order to increase the transmitting surface. On the basis of such idea, e.g., the sound columns have been developed which become directional at least in one direction, namely in vertical direction [bunched directivity diagram]. [Lamoth E. and co-workers: "Nagycsoporthatasu hangoszlop" — "Sound column of large group effect" Hungarian patent specification No. 157.232]. The backward radiation, especially towards the lower frequencies, is not reduced even with these methods. This is obvious since in order to achieve a forward-backward relation of, e.g., 9 – 10 dB value at 100 c/s, it can be easily calculated that a radiation surface of about 2 m diameter is necessary [above cited work of Beranek, p. 104]. The application of phase shifting members to the sound radiators in the same way as with the microphones does not serve the purpose either. The reason thereof is that the phase shifting member connected to the membrane of the loudspeaker results in an acceptance factor lower than the unit, even in case of ideally mass-prohibited membrane, under the half value of the frequence [$f_h = 1/2\ \pi\tau$] determined by the time constant $\tau$ of the phase shifting member which factor displays a further fall of 6 dB/octave towards the lower frequencies [FIG. 3]. The frequency response of sound radiators designed in this manner is satisfactory only in a few cases [e.g., in case of information transmission] due to the considerable drop in the direction of the low frequencies. [See cited work of Iding]. The simple application of the methods, usual with the microphones is not expedient since they are directed to the reduction of the membrane resonance, in case of sound radiators, however, the difficulty is caused not thereby, as it was seen.

The present invention offers a solution for the problems enumerated with the loudspeakers and ensures that the cardioid loudpspeaker could have in addition to its directionality also a nearly straight frequency characteristic even in the low-frequency range. Thereby a cardioid sound radiator is produced which has wide band, being thus suitable also for receiving musical programs and simultaneously all advantages offered by the cardioid directivity diagram can be utilized. The fact has been recognized that a phase shifting member can be used at most between the half and the double of the frequency determined by its time constant so that with its direction the value and variation of the transmission factor are still satisfactory. Therefore a solution for acoustic network has been looked for and found by means of which it can be achieved that at least two phase shifting members are connected to the membrane in such a way that the utilizable bands of both members are used. In case of loudspeaker or sound radiator, this means that the value of the transmission factor caused by the direction displays a nearly straight line even at the lower frequencies apart from the minor variation, around the unit value. The same solution accordingly results in case of microphones therein that the frequency response of the microphone continuously increases by a slope of about 6 dB/octave towards the lower frequencies. The recognized possibility and its realization can be achieved in principle and proved practically only under severe conditions and just these conditions have been utilized when designing the wide-band cardioid acoustic radiator.

The subject matter of the invention is a directional electro-acoustical converter, primarily an electrodynamic moving-coil loudspeaker, and sound radiating system, respectively, having cardioid directivity diagram which contains at least two phase shifting members known by themselves, expediently equalized to the so-called second degree, being connected to the membrane of the loudspeaker and the phase shifting members having aperture or apertures giving on the space in the known manner, which aperture(s) is (are), as compared to the front radiating side of the membrane, at a given (average) sound route distance. The essence of the invention consists in that the at least two phase shifting members are connected to the membrane is such a way that the phase shifting member having smaller (average) sound route distance is connected directly, or by a capacitor built up of at least one acoustic resistance and/or with at least one auxiliary membrane to the membrane, whereas the other phase shifting members of greater (average) sound route distance are connected to the membrane by at least one acoustic resistance and/or at least one mass, while the wave length quarters belonging to the transposition frequency determined by the coupling elements of the two phase shifting memebrs are at least of identical value but at most of fourfold value as compared to the smaller average sound route distance. The embodiment of the directional converter according to the invention has advantageous properties in which the larger sound route distance is at most the quadruple of the smaller sound route distance. A relatively simple construction is ensured by the embodiment of the invention in which both phase shifting members are of RC type and the phase shifting member having smaller sound route distance is connected to the membrane directly, whereas the phase shifting member having larger sound route distance through an acoustic resistance and mass connected in parallel so that the time constant determined by the resistance and by the mass is lower than the reciprocal of the transposition angular frequency multiplied by the ratio of sound routes. The former embodiment of the invention has advantageous transmission characteristics if the value of the mass carrying out the coupling is lower than the acoustic mass represented by the membrane. Advantageous geometric dimensions are ensured by the embodiment of the invention in which the phase shifting member having smaller sound route distance is of RC type and is connected to the membrane by means of an acoustic resistance in such a way that the capacity represented by the auxiliary membrane is higher than the capacity of the phase shifting member. A still wider transmission band is provided for by the embodiment of the invention according to which to the phase shifting member larger sound routes further phase shifting members having continually larger sound routes are coupled in the same way as the first two are coupled to each other.

The advantage of the solution according to the invention consists in that in case of loudspeaker it provides for a wide transmission band so that simultaneously the directionality can be also maintained. Thus high-quality musical representation can be ensured even in rooms of poor acoustics and the disturbing effect of the long period of after-oscillation of the rooms can be considerably reduced.

The clarity, the exemption from resonance, the intelligibility of the program transmitted by the sound radiating or loudspeaker system according to the invention are considerably improved and the risk of singing is reduced. In case of stereophonic transmission the area of stereophonic effect is increased. In case of microphones, it renders possible the use of microphone of special construction, the frequency response of which is of upraise character towards the low frequencies while the highfrequency sensitivity is of unchanged value.

The subject matter of the invention will be now described more detailed in connection with embodiments by way of example, on the basis of the drawing, in which FIG. 1 shows a known cardioid loudspeaker arrangement.

Figure 4:
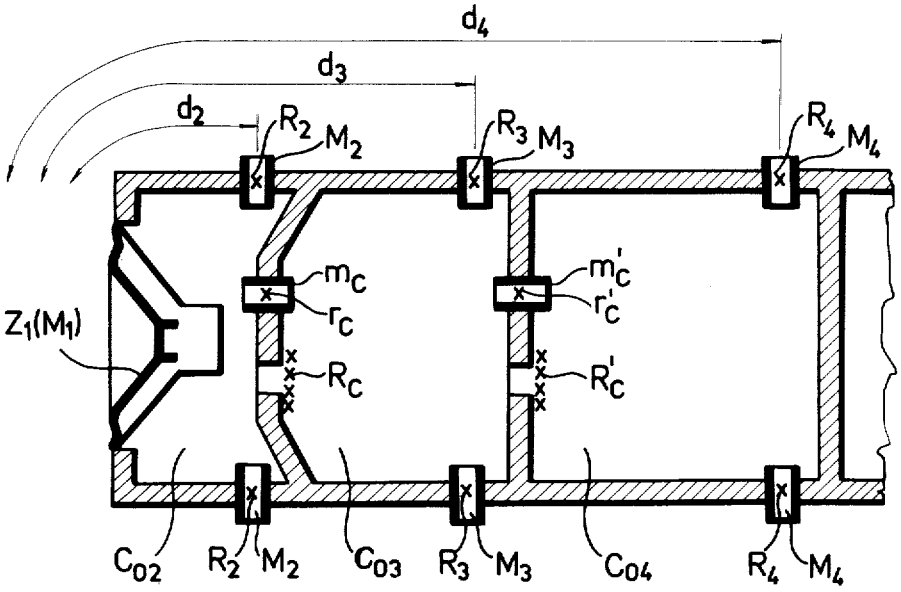
FIG. 4 illustrates a cardioid converter according to the invention.
Figure 5:
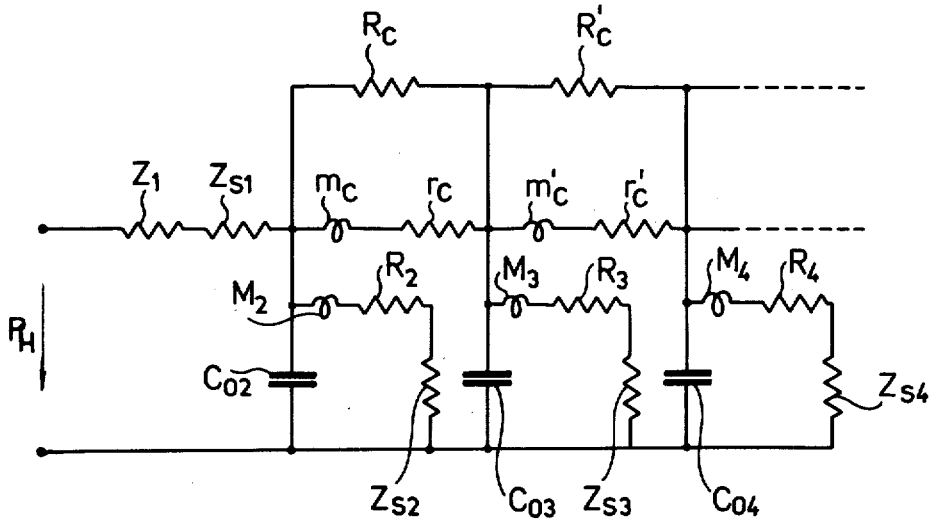
FIG. 5 is the electric substitution image of the converter shown in FIG. 4.
Figure 7:
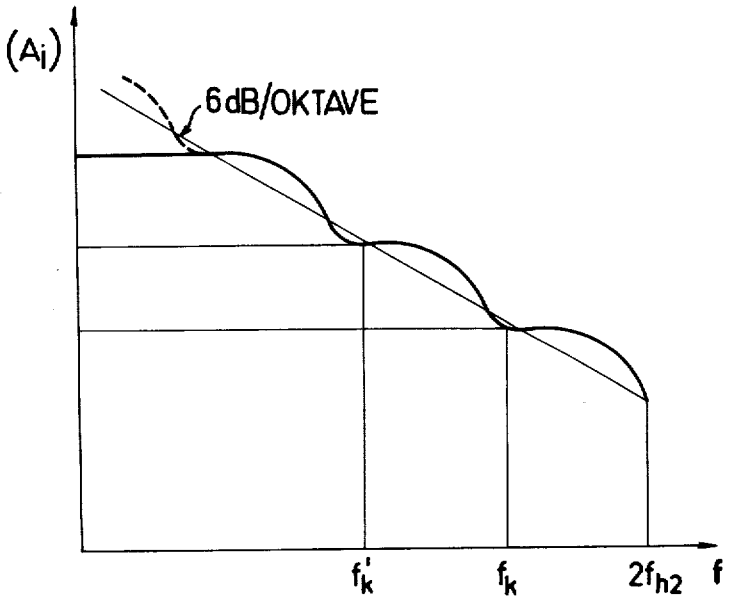

FIG. 7 displays the frequency response im microphone operating method of the converter shown in FIGS. 4 and 5.

Figure 8:
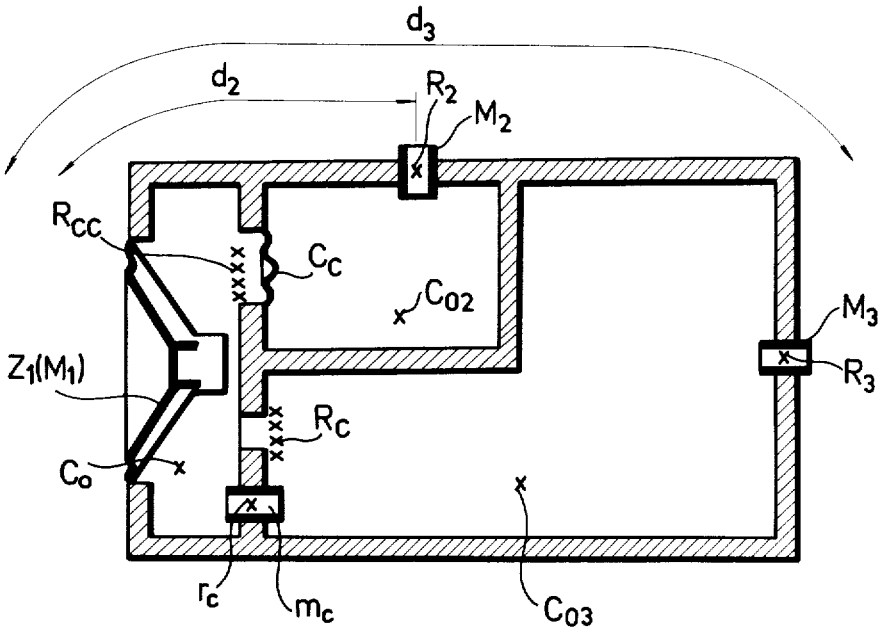

FIG. 8 illustrates another arrangement of the cardioid loudspeaker according to the invention.

Figure 9:
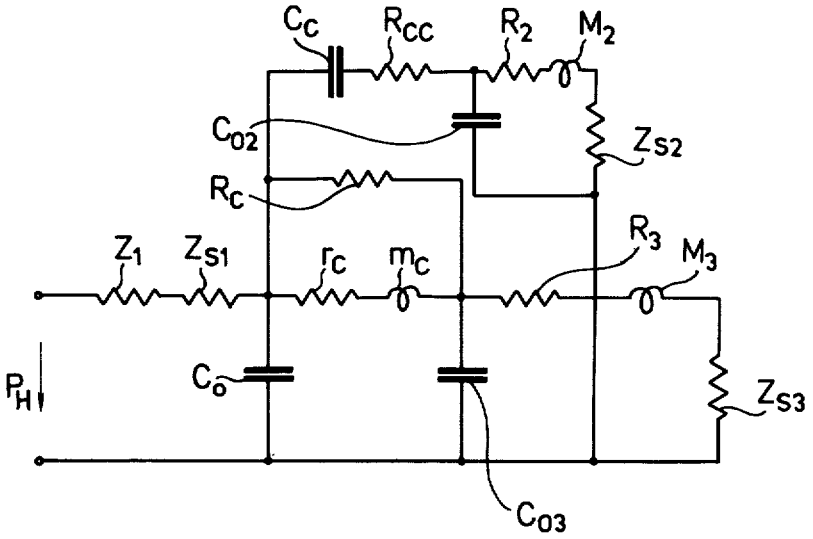

FIG. 9 representst the electric substitution image of the loudspeaker shown in FIG. 8.

Figure 1:
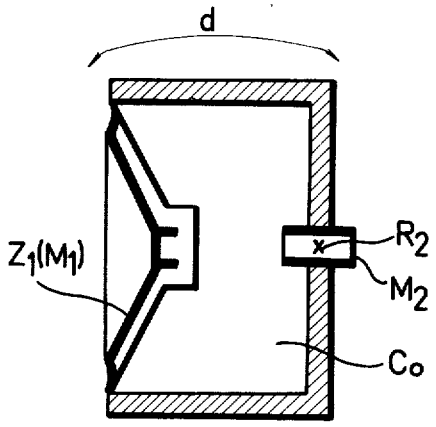

In FIG. 1 a known cardioid loudspeaker arrangement is shown. Here, behind the membrane $Z_1$, connected thereto, the phase shifting member of RC type [$R_2$ and $C_2$] operates completed by an acoustic mass $M_2$ in such a way that it provides for a network equalized to the second degree in the known manner. The (average) sound route distance between the aperture giving to the open space of the phase shifting member and the front side of the membrane is marked with *d*. If the elements $R_2$ and $M_2$ have several apertures the sound route distance is given by an average value. The capacity $C_o$ is determined by the volume of the box.

Figure 2:
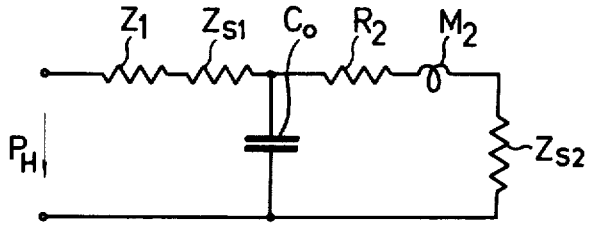
FIG. 2 is the electric equivalent image of the loudspeaker shown in FIG. 1.

In FIG. 2 the electric equivalent image of the loudspeaker according to FIG. 1 is to be seen. For the sake of better intelligibility the same markings are used in both figures. $Z_{s1}$ indicates the radiation impedance of the membrane, whereas $Z_{s2}$ the radiation impedance of the aperture giving to the open space of the phase shifting member. The time constant of the phase shifting member is, in case of ideal cardioid characteristic, identical in known manner with the sound propagation time referred to the sound route distance *d* that is $\tau = R_2C_o = d/c$. Here *c* is the velocity of sound propagation in the air. The reciprocal of the time constant gives the spot of frequency $f_h$ characterizing the frequency response of the transmission factor, namely $$f_h = 1/2\,\pi\,\tau = 1/2\,\pi\,R_2C_o = c/2\,\pi\,d$$

Figure 3:
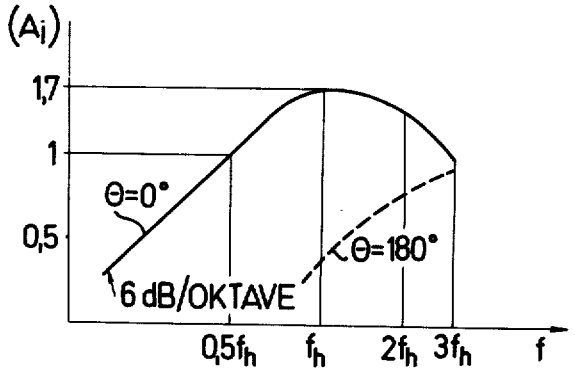
FIG. 3 represents the frequency response of the relative transmission factor of the cardioid loudspeaker shown in FIGS. 1 and 2.

In FIG. 3 the frequency response of the transmission factor $A_i$ resulting from the directionality of the cardioid loudspeaker shown in FIGS. 1 and 2 is illustrated in the "forwards" direction [0 = 0°] and "backwards" direction [0 = 180°] of the loudspeaker. It can be clearly seen that at frequencies $f < f_h/2$ the transmission factor falls under the value 1, whereas at frequencies $f > 2f_h$ the so-called forwards-backwards ratio characterizing the directionality is spoiled.

In FIG. 4 an embodiment of a converter having cardioid directivity diagram according to the invention is shown by way of example, whereas in FIG. 5 the electric equivalent image thereof is illustrated. To the membrane $Z_1$ the phase shifting member of RC type having a sound route distance $d_2$ is directly connected, being in present case completed by the mass $M_2$, thus being equalized to the second degree. The time constant of the phase shifting member expediently satisfies the $\tau_2 = R_2C_2 = d_2/c$ equality [cardioid directivity diagram], consequently its characteristic frequency is $f_{h2} = 1/2\pi\tau_2$. The phase shifting member of RC type having a sound route distance $d_3$, longer than the sound route distance $d_2$, which consists of elements $R_3$, $C_{o3}$, $M_3$, and the time constant of which is $\tau_3 = R_3C_{o3} = d_3/c$ and consequently $f_{h3} = 1/2\pi\tau_3$ is coupled to the membrane $Z_1$ by the parallelly connected acoustic resistance $R_c$ and mass $m_c$.

Additionally a series member $r_c$ is connected to the mass $m_c$. The two phase shifting members of the converter developed in this way and the coupling impedance determine a transposition frequency the value of which is:

$$f_k = \frac{1}{2\pi}\sqrt{\frac{d_2/R_3 + r_c/ + d_3R_2}{d_2R_3}\cdot\frac{1}{m_cC_{03}}} \sim \frac{1}{2\pi}\sqrt{\frac{d_3R_2}{d_2R_3}\cdot\frac{1}{m_cC_{03}}}$$

The values of some phase shifting and coupling elements, that is the frequencies $f_k$ have been chosen so that the quarter of the pertaining wave length $\lambda = c/f_k$ should be at least identical with, but at most the quadruple of the sound route distance $d_2$, that is $d_2 \leqq \lambda_k/4 \leqq 4d_2$. In order to maintain the directionality even at high frequencies, it proved to be expedient to choose the time constant $\tau_c$ of the coupling impedance to be lower than the reciprocal of the transposition angular frequency multiplied by the $d_3/d_2$ sound route ratio. Numerically:

$$\tau_c = \frac{m_c}{R_c} < \frac{1}{\frac{d_3}{d_2}\omega_k} \text{ where } \omega_k = 2\pi f_k$$

In order to achieve a larger band width, further phase shifters shall be expediently coupled in the above said manner. Thus the phase shifting member of RC type having a sound route distance $d_4$ is coupled with the elements $m_c'$, $r_c'$ and $R_c'$ to the preceding phase shifting member. For this coupling those said above for the coupling of the first two members are valid. Thus, the transposition frequency is obviously $$f_k = \frac{1}{2\pi}\sqrt{\frac{d_3/R_4 + r'_c/ + d_4R_3}{d_3R_4}\;\frac{1}{m'_cC_{04}}} \sim \frac{1}{2\pi}\sqrt{\frac{d_4R_3}{d_3R_4}\;\frac{1}{m'_cC_{04}}}$$

$Z_{s1}$ marks the radiation impedance of the membrane, whereas $Z_{s2}$, $Z_{s3}$ . . . that of the apertures giving to the open space of the phase shifting members. If several apertures giving to the open space are used with the phase shifting member, evidently the resultant of the acoustic resistances and of the masses represented by these apertures gives the values of $R_2$, $m_2$ and $R_3$, $m_3$, respectively. At the same time the sound route distances belonging to these apertures result in an average sound route distance.

Figure 6:
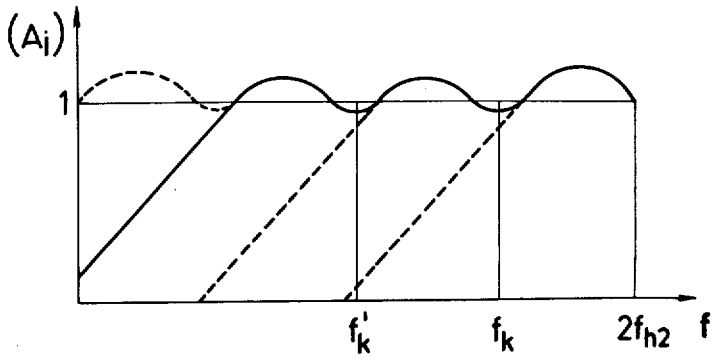
FIG. 6 represents the frequency response of the relative transmission factor indicated in loudspeaker operating method of the converter shown in FIGS. 4 and 5.

In FIG. 6 the frequency response of the transmission factor in loudspeaker operating method of the converter shown in FIGS. 4 and 5 is illustrated. It is clearly to be seen in the figure that the phase shifting members are succeeded at a transposition frequency $f_k$ then at that $f_k'$ by the phase shifting member having larger sound route distance. Those frequency responses are indicated by dotted line which would be provided for without succession by the phase shifting members. The figure indicates further on that the transposition frequencies can be easily measured if the operation of the following phase shifting member is inhibited. This may be achieved by blocking of the coupling impedance thus, e.g., in case of $f_k$ by the covering of $m_c$ and $R_c$. The fluctuation of the transmission factor $A_i$ can be taken for having the much lower value the lower the $d_3/d_2$ ratio is. Just therefore it proved to be expedient for the ratio of the succeeding sound route distance not to surpass four, that is $d_3/d_2 \leqq 4$, then $d_4/d_3 \leqq 4$ . . . etc.

In FIG. 7 the frequency response of the transmission factor $A_i$ in microphone operating method of the converter shown in FIGS. 4 and 5 is illustrated. The frequency response of the microphone is of upraise character and varies around a straight line raising by 6 dB/octave. The dotted line represents also in this case the frequency response of the individual phase shifting members.

In FIG. 8 another possible arrangement of the cardioid loudspeaker according to the invention is illustrated, whereas FIG. 9 shows the electric equivalent image of this arrangement. For sake of the better understanding similar markings are used again. To the membrane $Z_1$ the phase shifting member of RC type having $d_2$ sound route distance [consisting of elements $R_2$, $C_{o2}$ and $M_2$] is coupled by means of the capacity $C_c$ and acoustic resistance $R_{cc}$. The capacity $C_c$ is ensured by an auxiliary membrane, the value of which is expediently higher than the value of capacity $C_{o3}$. The phase shifting member of RC type having a $d_3$ sound route distance [consisting of elements $R_3$, $C_{o3}$ and $M_3$] is coupled to the membrane by means of the parallelly connected mass $m_c$ and resistance $R_c$. The mass $m_c$ is possibly attenuated by the resistance $r_c$. Since none of the phase shifting members is directly coupled to the membrane, necessarily additional capacity $C_o$ shall be applied. As a matter of course, the arrangements shown both in FIG. 4 and in FIG. 8 can be realized also with cardioid directivity diagram and with all variants thereof, beginning with the hyper-cardioid directivity diagram up to the nearly "8" -shaped directivity diagram. The known condition thereof is that in case of cardioid directivity diagram the time constants of the phase shifting members should be identical with the running time belonging to the sound route distances [that is $\tau = d/c$], whereas in case of hyper-cardioid directivity diagram or nearly "8"-shaped directivity diagram $\tau \neq d/c$. The amount of inequality determines in the known manner the degree of the deviation from the ideal cardioid directivity diagrams.

What we claim is:

1. Directional electro-acoustical converter, comprising an electrodynamic moving-coil loudspeaker and sound radiator, at least two phase shifting members equalized to the second degree, said phase shifting members having apertures and being disposed at different distances from the front side of a membrane of the loudspeaker, the phase shifting member which is at the smallest distance ($d_2$) from the membrane being coupled directly to the membrane or by means of an acoustic resistance ($R_{cc}$) or by means of an auxiliary membrane ($C_{cc}$), said other phase shifting members at greater distances ($d_3$, $d_4$. . . ) from said membrane being coupled to the membrane each by means of at least one acoustic resistance ($R_c$, $R_c'$, $r_c$. . . ) or each by means of at least one mass ($m_c$ $m_c'$) such that the quarter of the wavelength $\lambda_k$ belonging to the transposition frequency ($f_k$) determined by the phase shifting members having $d_2$ and $d_3$ sound route distances has one to four times the value of the smallest sound route distance $D_2$, whereby $d_2 \leqq (\lambda k/4) \leqq 4d_2$.

2. Directional electro-acoustical converter as claimed in claim 1, in which the larger sound route distance ($d_3$) is at most four times the smaller sound route distance ($d_2$), whereby $d_2 \leqq d_3 \leqq 4d_2$.

3. Directional electro-acoustical converter as claimed in claim 1, in which all said phase shifting numbers are of the RC type and are equalized to the second degree, said phase shifting member having the smallest sound route distance ($d_2$) being coupled to the membrane ($Z_1$) directly, a said phase shifting member having a greater sound route distance ($d_3$) being coupled to the membrane ($Z_1$) by means of a parallel connected acoustic resistance ($R_c$) and mass ($m_c$) such that the time constant determined by the resistance of the mass is lower than the reciprocal of the transposition angular frequency ($\omega_k$) multiplied by the ratio of the sound routes ($d_3/d_2$), whereby $$\frac{m_c}{R_c} < \frac{1}{\frac{d_3}{d_2}\,\omega_k}.$$

4. Directional electro-acoustical converter as claimed in claim 1, in which the value of the mass ($m_c$) coupling the phase shifting member having a greater sound route distance ($d_3$) to the membrane is less than that of the acoustic mass ($M_1$) of the membrane, whereby $m_c < M_1$.

5. Directional electro-acoustical converter as claimed in claim 1, in which the phase shifting members are of the RC type, the phase shifting member having the smallest sound route distance ($d_2$) being coupled to the membrane by means of a capacity ($C_c$) comprised by an auxiliary membrane and by means of an acoustic resistance ($R_{cc}$) whereby said capacity is of higher value than the capacity ($C_{o2}$) of the phase shifting member, whereby $C_2 > C_{o2}$).

6. Directional electro-acoustical converter as claimed in claim 1, containing several phase shifting members of RC type having successively longer sound routes ($d_2$, $d_3$, $d_4$. . . ) which are coupled together one after the other such that the quarter of the wavelength of the transposition frequencies of two successive phase shifting members correspond at least to the sound route distance of the preceding phase shifting member and is equal to at most the quadruple of the latter sound route length.

* * * * *